US006194645B1

(12) United States Patent
Rose

(10) Patent No.: US 6,194,645 B1
(45) Date of Patent: Feb. 27, 2001

(54) STRINGED INSTRUMENT HAVING A HIDDEN TREMOLO

(76) Inventor: Floyd D. Rose, 117 Via de la Valle, Del Mar, CA (US) 92104

( * ) Notice: Under 35 U.S.C. 154(b), the term of this patent shall be extended for 0 days.

(21) Appl. No.: 09/238,816

(22) Filed: Jan. 28, 1999

(51) Int. Cl.[7] ..... G10D 3/00
(52) U.S. Cl. ..... 84/313
(58) Field of Search ..... 84/291, 297 R, 84/267, 298, 299, 300–304, 297 S, 307, 308, 309, 312 R, 313

(56) References Cited

U.S. PATENT DOCUMENTS

| | | | | |
|---|---|---|---|---|
| 2,976,755 | | 3/1961 | Fender . | |
| 3,678,795 | | 7/1972 | Fullerton . | |
| 3,763,736 | | 10/1973 | Williams . | |
| 3,911,777 | | 10/1975 | Rendell . | |
| 3,911,778 | | 10/1975 | Martin . | |
| 3,915,049 | | 10/1975 | Bean . | |
| 4,027,570 | | 6/1977 | Rendell et al. . | |
| 4,111,903 | | 9/1978 | Field et al. . | |
| 4,135,426 | | 1/1979 | Rickard . | |
| 4,142,435 | | 3/1979 | Pozar . | |
| 4,201,108 | | 5/1980 | Bunker . | |
| 4,241,637 | | 12/1980 | Brent . | |
| 4,283,982 | | 8/1981 | Armstrong . | |
| 4,377,101 | | 3/1983 | Santucci . | |
| 4,425,831 | | 1/1984 | Lipman . | |
| 4,433,603 | | 2/1984 | Siminoff . | |
| 4,462,229 | | 7/1984 | Hundley . | |
| 4,472,994 | | 9/1984 | Armstrong . | |
| 4,497,236 | * | 2/1985 | Rose | 84/298 |
| 4,522,101 | | 6/1985 | Peavey et al. . | |
| 4,573,391 | | 3/1986 | White . | |
| 4,638,708 | | 1/1987 | Kamal . | |
| 4,677,891 | * | 7/1987 | Gressett, Jr. et al. | 84/313 |
| 4,681,011 | * | 7/1987 | Hoshino | 84/313 |
| 4,793,236 | | 12/1988 | McGuire et al. . | |
| 4,803,906 | | 2/1989 | Fender . | |
| 4,840,102 | | 6/1989 | Pittman . | |
| 4,854,210 | | 8/1989 | Palazzolo . | |
| 4,905,563 | | 3/1990 | Davies . | |
| 4,939,970 | | 7/1990 | Hoshino et al. . | |
| 4,982,640 | | 1/1991 | Buscarino . | |
| 5,012,716 | | 5/1991 | Pagelli . | |
| 5,014,588 | | 5/1991 | Omata et al. . | |
| 5,033,353 | | 7/1991 | Fala et al. . | |
| 5,052,269 | | 10/1991 | Young, Jr. . | |
| 5,072,646 | | 12/1991 | Valkama . | |
| 5,125,311 | | 6/1992 | Boulanger et al. . | |
| 5,136,918 | | 8/1992 | Riboloff . | |
| 5,337,643 | | 8/1994 | Cantrell . | |
| 5,347,904 | | 9/1994 | Lawrence . | |
| 5,353,672 | | 10/1994 | Stewart . | |
| 5,390,578 | | 2/1995 | Raymer . | |
| 5,398,581 | | 3/1995 | Castillo . | |
| 5,421,233 | | 6/1995 | Bunder . | |
| 5,452,637 | | 9/1995 | DeCola . | |
| 5,458,035 | | 10/1995 | Okamura . | |
| 5,519,165 | | 5/1996 | Gregory . | |
| 5,549,027 | | 8/1996 | Steinberger et al. . | |
| 5,567,903 | | 10/1996 | Coopersmith et al. . | |
| 5,589,653 | | 12/1996 | Rose . | |
| 5,600,078 | | 2/1997 | Edwards . | |
| 5,614,688 | | 3/1997 | Donnel . | |
| 5,631,432 | | 5/1997 | Muncy . | |
| 5,637,823 | | 6/1997 | Dodge . | |
| 5,661,252 | | 8/1997 | Krawczak . | |
| 5,679,910 | | 10/1997 | Steinberger et al. . | |
| 5,717,150 | | 2/1998 | Rose . | |
| 5,847,297 | * | 12/1998 | Fisher, IV | 84/313 |
| 5,907,114 | * | 5/1999 | Culver | 84/313 |

* cited by examiner

*Primary Examiner*—David Martin
*Assistant Examiner*—Kim Lockett
(74) *Attorney, Agent, or Firm*—Lerner, David, Littenberg, Krumholz & Mentlik, LLP

(57) ABSTRACT

A stringed instrument, such as a guitar is provided. The stringed instrument includes a tremolo having a "hidden" tremolo plate for activating the tremolo.

17 Claims, 9 Drawing Sheets

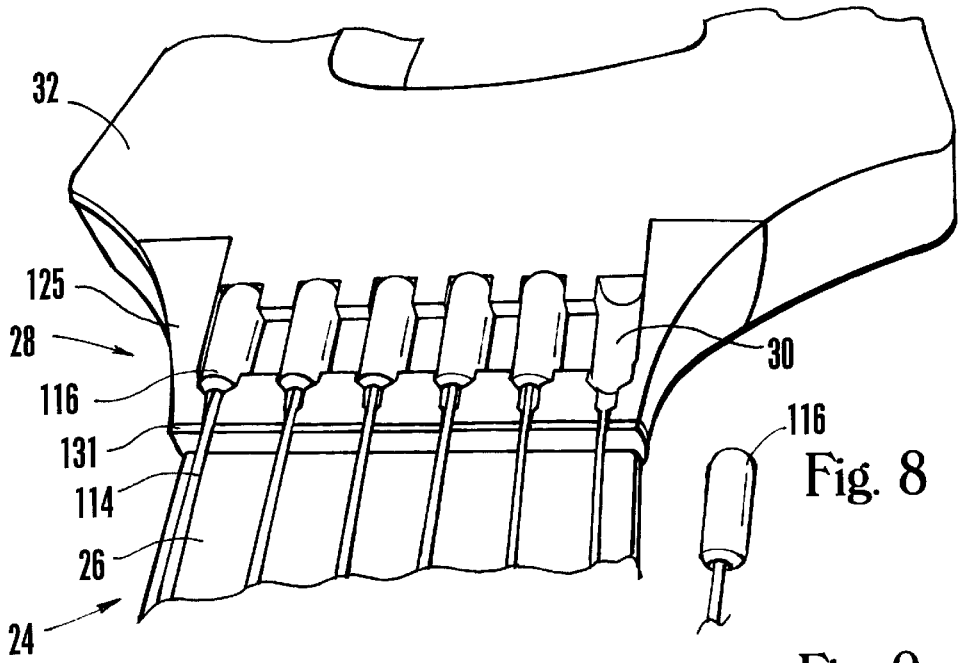
Fig. 8
Fig. 9
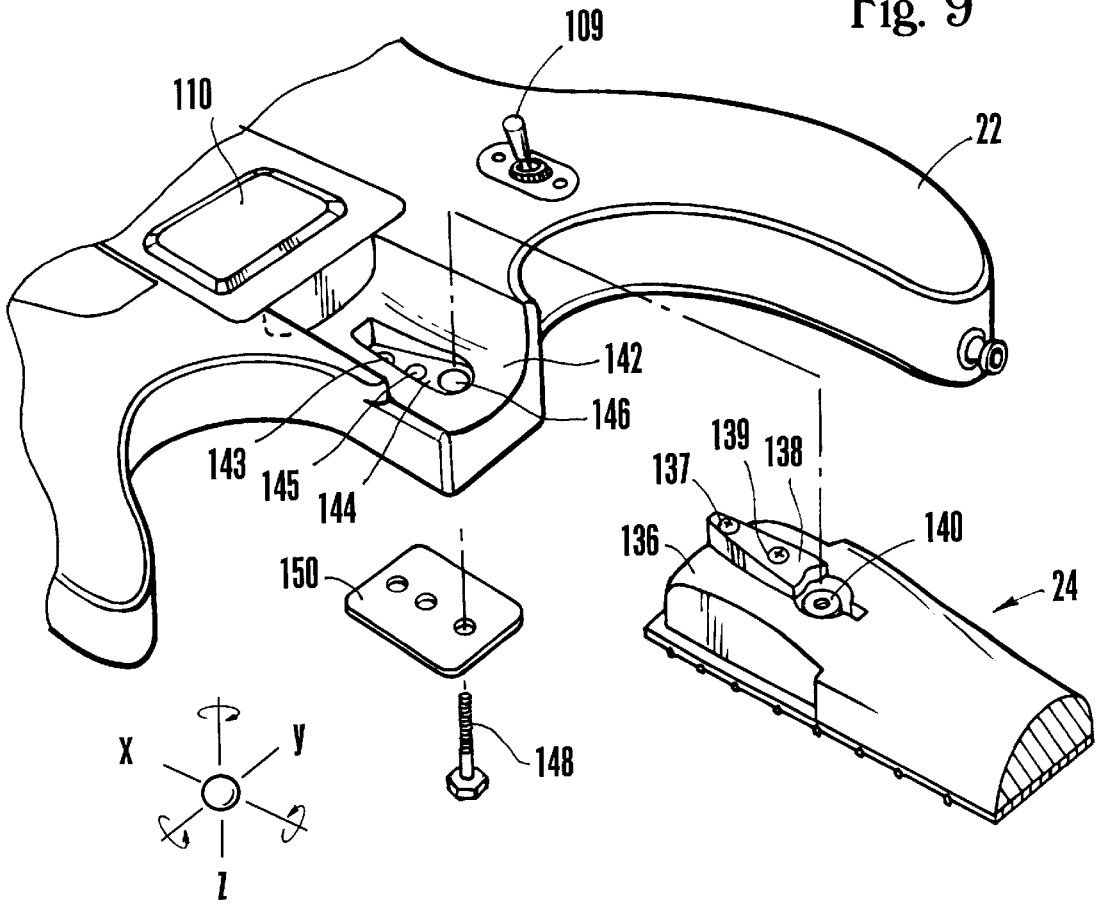

STRINGED INSTRUMENT HAVING A HIDDEN TREMOLO

FIELD OF THE INVENTION

The present invention relates to stringed instruments, such as guitars and various components thereof.

BACKGROUND OF THE INVENTION

Inventors have expended great efforts over the years in their efforts to obtain an optimal tuning system for use with stringed musical instruments, such as guitars. These efforts are indicative of the need for improvement in this field. One particularly significant improvement was developed by the same inventor of the present invention and is disclosed in U.S. Pat. No. 5,705,760. The disclosure in the '760 patent includes, among other improvements, a "convergence" tuning system where harmonic tuning and pitch tuning can be simultaneously and easily obtained by a user of the guitar.

Standard guitars typically include six strings corresponding to the musical notes E, A, D, G, B and E. Guitar strings are placed under tension and extend at a substantially constant height above a fretboard mounted on the neck and the guitar body. In order to produce the sounds associated with the musical notes, the strings are placed in contact with two critical contact points. The first critical contact point is generally at the nut of the instrument, which is usually arranged on the guitar neck adjacent to the first fret of the fretboard. The second critical contact point is generally at the bridge of the instrument, which is provided on an opposing end of the fretboard on the body of the instrument. The strings are fixed at a distance beyond the critical contact points at the nut and bridge.

As is known to those skilled in the stringed instrument art the sound produced by the strings is affected by the harmonic length (i.e., the distance between where the strings contact the critical contact points at the nut and the bridge). Except for the guitar disclosed in the '760 patent, and in other cumulative patents obtained by the inventor herein, harmonic tuning of the strings has been a difficult process which needed to be performed by a professional. Harmonic tuning is accomplished by adjusting the distance between the critical contact points at the nut and bridge of the guitar.

The tension of the strings is a second factor which significantly affects the tone. String tension may be adjusted by tightening or loosening the string at the nut or bridge end of the guitar. Adjustment of the tension in the strings affects the pitch thereof and is commonly known as pitch tuning.

Except for the guitar disclosed in the '760 patent, and in certain other cumulative patents obtained by the inventor herein, prior art guitars required separate steps for pitch and harmonic tuning. For example, prior art tuning systems required each string of a guitar to be independently pitch and harmonically tuned by adjusting individual tension control elements while the distance between the critical contact points at the nut and the bridge are separately adjusted. In most prior art systems, proper harmonic and pitch tuning is obtained when strings ultimately reach a tuned state after many individual adjustments of separate tensioning and distance modifying controls.

Even in the improved guitar disclosed in the '760 patent, the bridge assembly does not include a force conversion device which converts nonlongitudinal forces (such as rotational, vertical and angular forces) into longitudinal forces to effect slidable movement of one or more saddle members arranged on a bridge assembly. The present invention addresses this need.

When using electric guitars, it is often desirable to use pick-ups which include magneto-electro transducer elements designed to detect vibrations in associated guitar strings. Certain sophisticated guitar players demand the ability to adjust various aspects of their guitar including the arrangement of pick-ups with respect to the strings. Although prior art inventors have exerted efforts to create movable pick-up systems, all such prior art systems have drawbacks. No prior art system includes a mechanical control assembly, which allows a user to easily adjust the location of pick-ups to a desired position.

The prior art also fails to disclose or teach a guitar including a pick-up assembly having covers arranged on the guitar body over a slidable pick-up assembly and beneath associated strings where the cover extends substantially parallel to the surface of the guitar body.

Tremolos are well known devices that are typically used with electric guitars to simultaneously and significantly either reduce or increase the tension of the strings of the guitar so that a desired variation in tone is obtained. Significant improvements in tremolo devices are disclosed in U.S. Pat. Nos. 4,171,661; 4,967,631; 4,497,236; and 4,882,967, all of which have been issued to the inventor of the present invention. Prior art tremolo systems typically include a raised tremolo arm which extends substantially above the surface of the guitar body. No prior art system discloses the use of a tremolo having a plate which extends substantially flush with the surface of the body of the guitar.

Another aspect of the present invention which is not disclosed in the prior art relates to a neck which is releasably and adjustably mounted on a guitar body. Sophisticated guitar players may wish to customize the action of the strings with respect to the fretboard for their own liking. This may involve adjusting the strings in any of three dimensions including the height of all of the strings on the fretboard, and the side-to-side alignment of the strings with respect to the fretboard (e.g., most guitar players prefer the strings to be centered on the fretboard, but with the low and high strings at different heights from the surface of the fretboard). Prior art guitars do not provide the user with the ability to customize the action of the strings based on a readily adjustable arrangement between the neck and the body, where the neck can be removed and replaced during travel and storage without modifying the previously customized setting.

There is also a need for a guitar, or other stringed instrument, which includes a modular headstock. While efforts have been made to develop readily removable and replaceable headstocks for guitars, the prior art fails to teach a system which includes removable head stocks where one headstock does not include tuning pegs, but the other head stock does.

The present invention addresses the shortcomings of the prior art by providing an improved stringed instrument, such as a guitar, which fills the foregoing needs.

SUMMARY OF THE INVENTION

The present invention overcomes the shortcomings of the prior art by providing a stringed instrument which includes a hidden tremolo. A preferred embodiment may include a tremolo bridge having a tremolo plate, which extends substantially coplanar (i.e., flush) with the surface of a body.

The stringed instrument preferably comprises a body including a substantially planar surface and a cavity arranged beneath the surface. A plurality of strings are also provided and extend above and along the body. The tremolo bridge may be mounted on the body. Preferably, the tremolo bridge includes a plate which encloses an opening to the cavity of the body. The plate may extend substantially coplanar with respect to the surface of the body.

The stringed instrument may also comprise a neck having a first end mounted on the body, and a second end remote from the body. It is also preferable for the stringed instrument to comprise a nut connected to the neck. In this preferred embodiment, the plurality of strings may extend between the tremolo bridge and the nut. It is also preferable for the stringed instrument to comprise a fretboard mounted on the neck such that the strings extend along and above the fretboard.

The tremolo bridge of the present invention is preferably operatively connected to the body such that a user of the stringed instrument can obtain a desired sound upon activation of the tremolo bridge by pressing on the tremolo plate whereby tension in the strings is momentarily decreased or increased and is then returned. The tremolo bridge may be mounted for movement between a rest position where the plate is substantially coplanar with respect to the surface of the body, and an operative position where at least a portion of the plate extends below the surface of the body.

The tremolo bridge may include a spring arranged within the cavity of the body to bias the plate to the rest position. The plate preferably has a first end connected to a base of the bridge and a second end remote from the base. In this preferred embodiment, the second end is movable from its rest position where it is substantially coplanar with the surface of the body to an operative position where it extends below the surface of the body.

In the preferred embodiment where the second end of the plate is movable from its rest position to an operative position where it extends below the surface of the body, tension in the strings is decreased. In an alternate embodiment, the tremolo bridge may also be movable from its rest position where the plate is substantially coplanar with the surface of the body, to an operative position where the plate extends above the surface of the body at which time tension in the strings is increased.

The above features and advantages of the present invention will be more fully understood with reference to the following detailed description when taken in conjunction with the accompanying drawings.

BRIEF DESCRIPTION OF THE DRAWINGS

FIG. 8 is an enlarged isolated partially exploded view of the nut assembly and associated guitar strings shown in FIG. 4.

FIG. 9 is a partially exploded perspective view the neck and body of the present guitar.

DETAILED DESCRIPTION OF THE PREFERRED EMBODIMENTS

Figure 1:
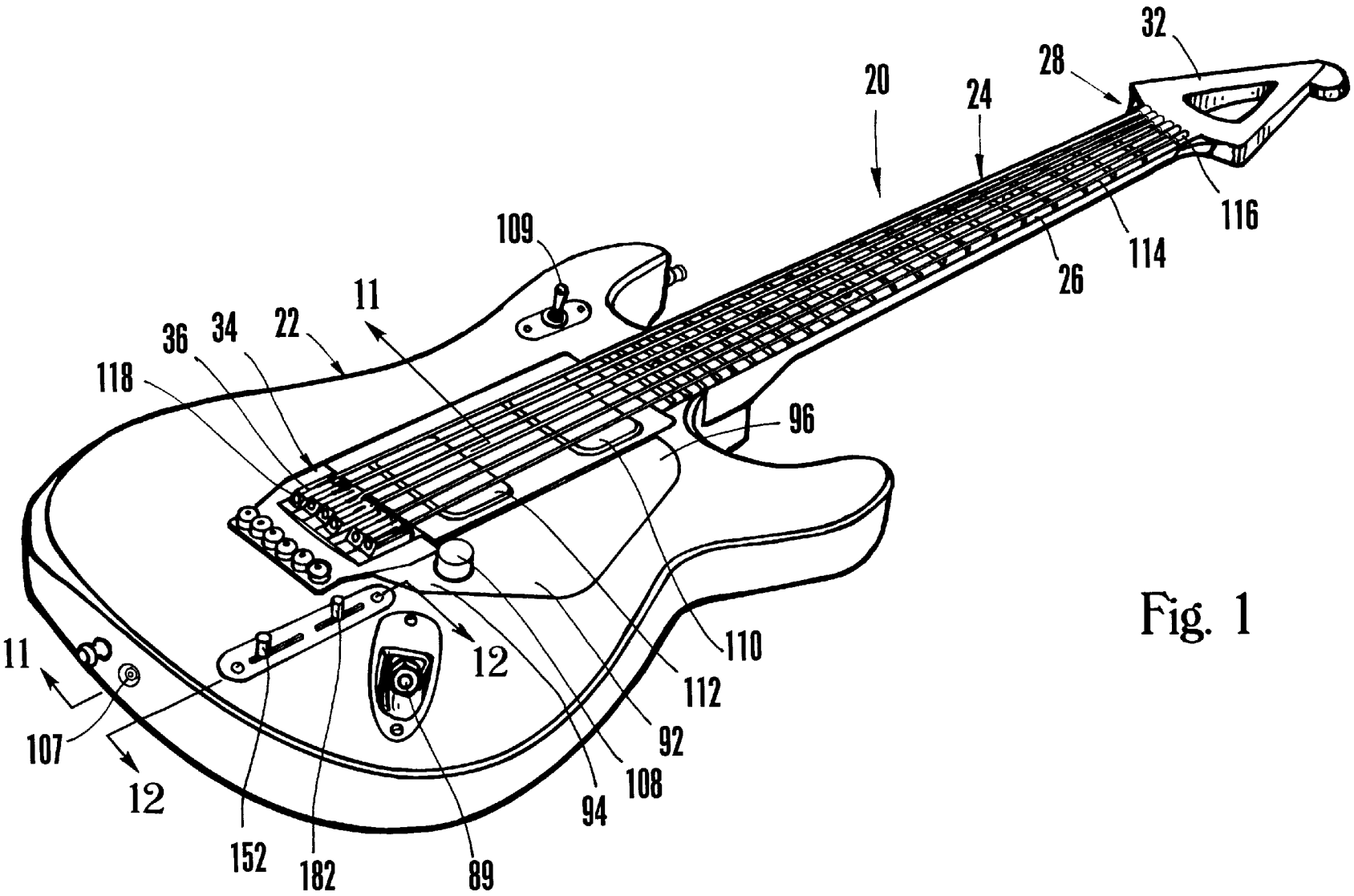
FIG. 1 is a perspective view of a guitar including the features of the present invention.

A guitar 20 in accordance with a first embodiment of the present invention is shown in FIG. 1. The guitar 20 may be an electric guitar. However, it should be appreciated that the present invention can be used in connection with various stringed instruments such as acoustic guitars, basses, violins, banjos and the like.

Figure 5:
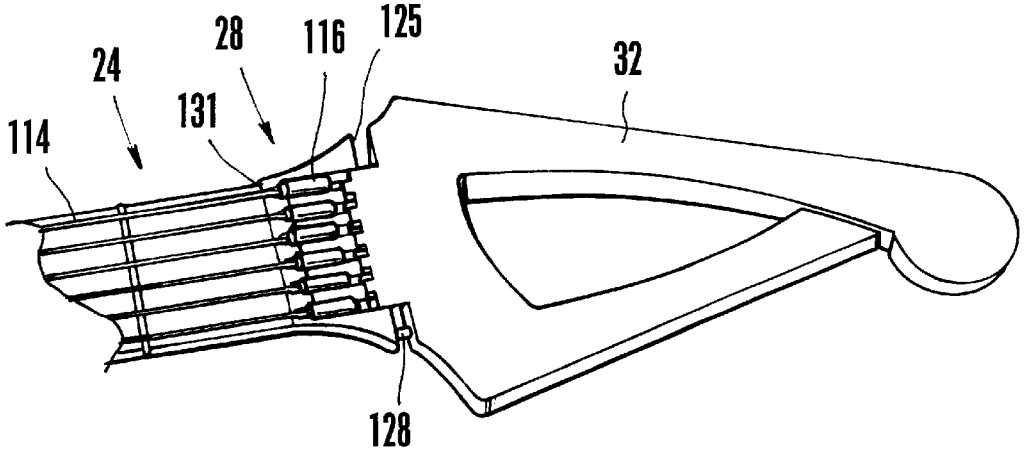
FIG. 5 is an isolated view of the convergence headstock and nut assembly portion of the guitar shown in FIG. 1.

The guitar 20 includes a body 22 and a neck 24 secured to the body 22 at a first end thereof. A second end of the neck 24 is remote from the body 22 and is connected to a headstock 32. The neck 24 has a fretboard 26 mounted on the top surface. A nut assembly 28 is arranged between the second end of the neck 24 and the headstock 32 as shown in FIGS. 1, 5 and 8.

The nut assembly 28 includes a plurality of string holder cavities 30, each of which retain a bullet-shaped anchor 116 arranged at one end of corresponding guitar strings 114. This aspect of the present invention is also shown in FIGS. 1, 5 and 8.

A bridge assembly 34 is mounted on body 22 spaced from nut assembly 28 at the second end of the neck. Various aspects of the bridge assembly 34 are unique and will now be discussed.

Figure 2:
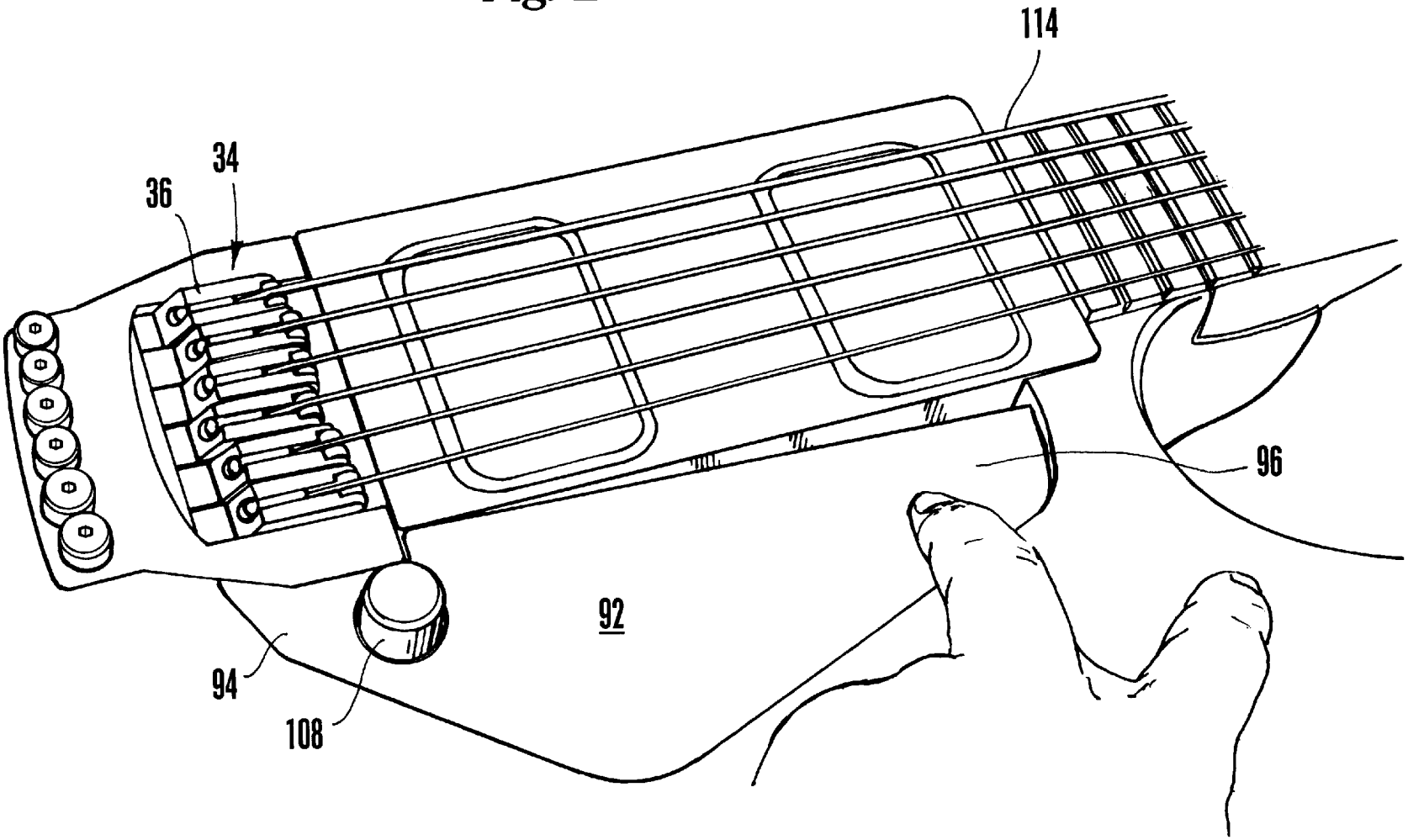
FIG. 2 is an isolated perspective view of a portion of the guitar shown in FIG. 1 illustrating the tremolo plate in a depressed position.
Figure 3:
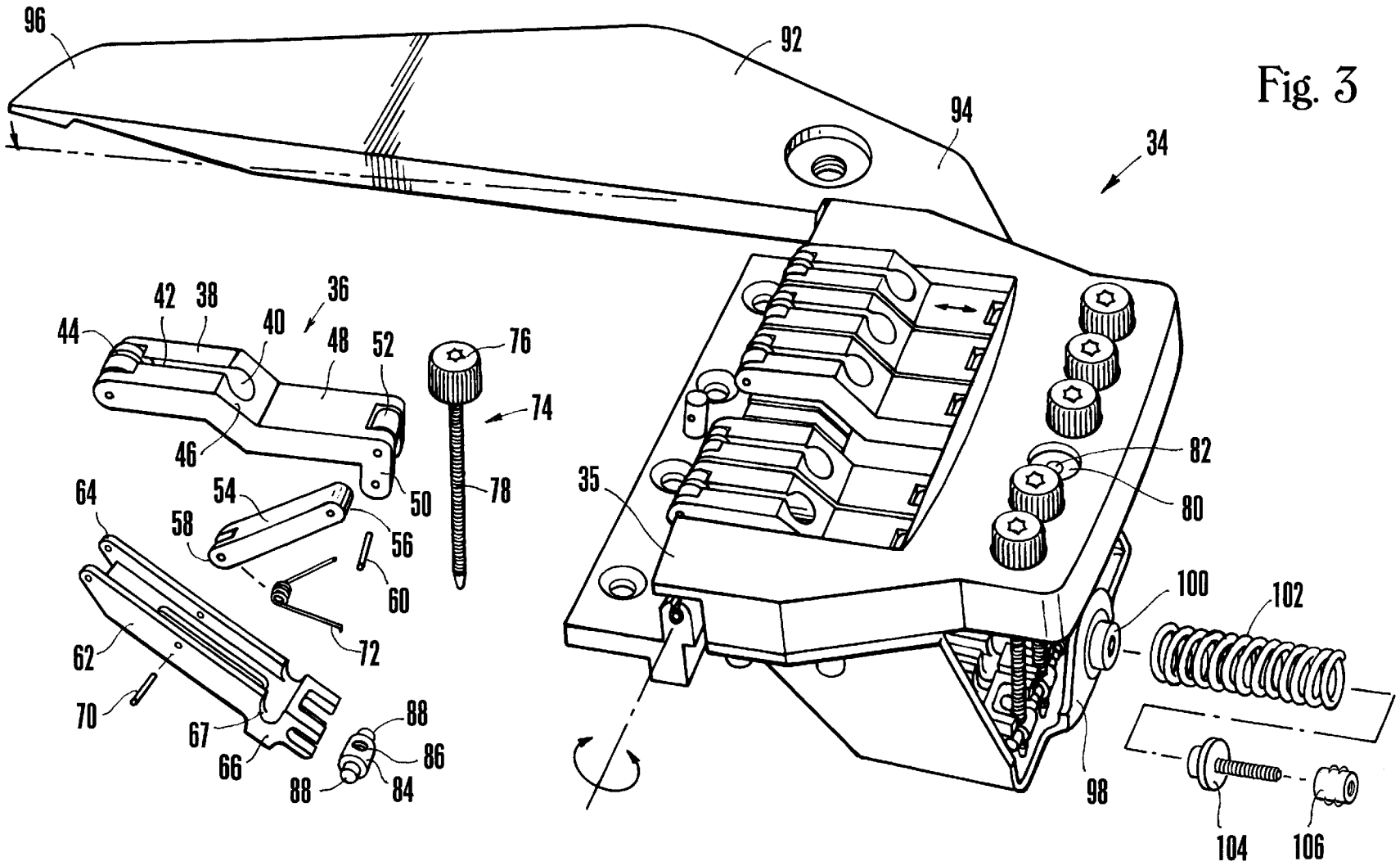
FIG. 3 is an exploded perspective view of the bridge and tremolo assembly shown in FIG. 2.
Figure 4:
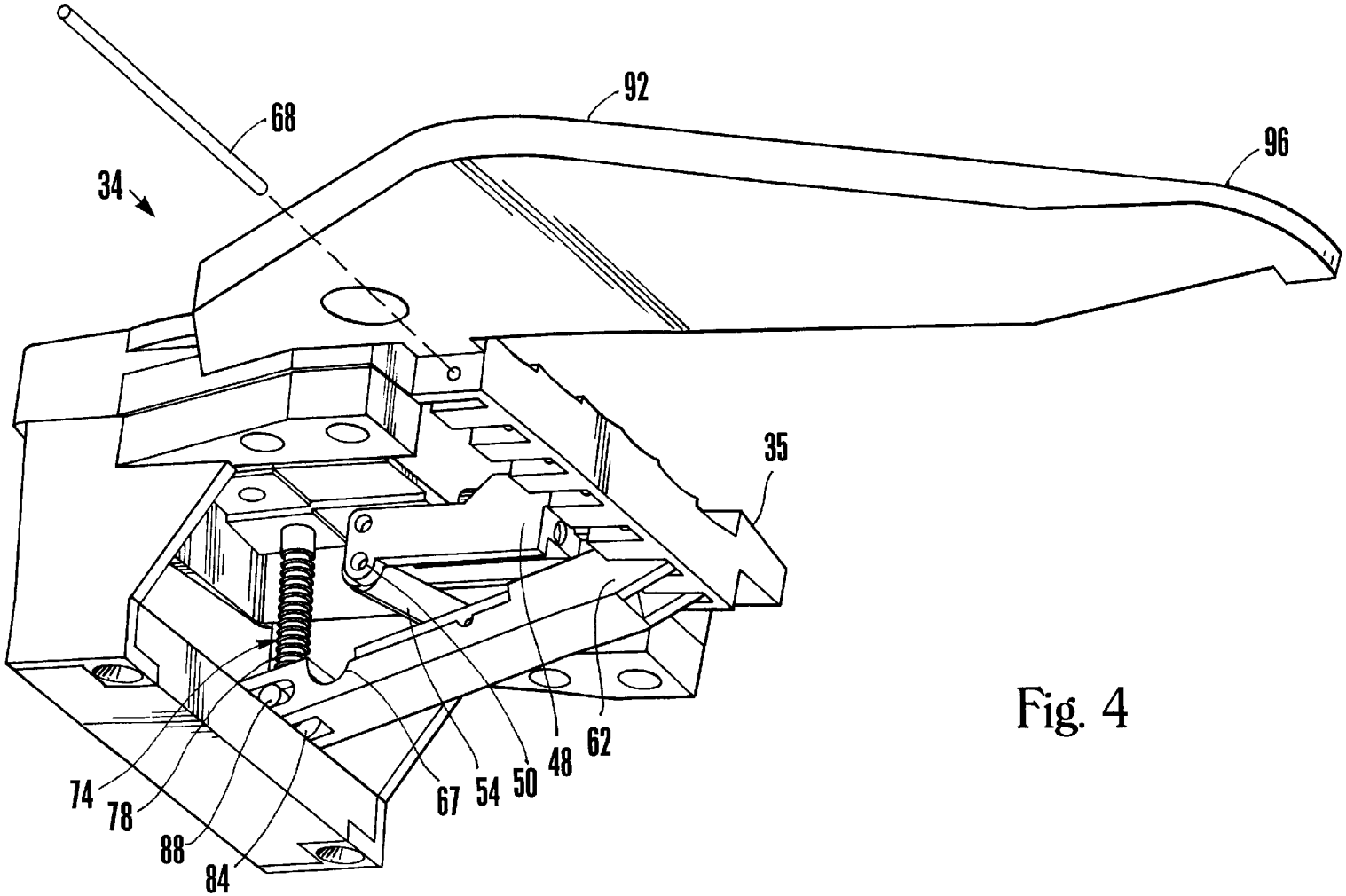
FIG. 4 is an isolated assembled bottom perspective view of the bridge assembly shown in FIG. 3.

As shown in FIGS. 2–4, the bridge assembly 34 includes a plurality of saddles 36 in which bullet-shaped anchors 118 of an end of guitar strings 114 are arranged. FIGS. 1, 5 and 8 also illustrate that each of the strings 114 include a pair of bullets at opposing ends. Bullet 116 is arranged at the "nut" end of the string and bullet 118 is arranged at the "bridge" end of the string. As noted above, and as used herein, the term "anchor" is intended to cover various types of objects which may be secured to one or both ends of an associated string for the purpose of facilitating fixation of the string with respect to the body and/or neck of the guitar. In a preferred embodiment, the anchor elements that are fixed to the ends of the string are bullet-shaped. The bullet-shaped anchor elements will be referred to herein as "bullets." In other embodiments, the anchor elements may comprise balls, blocks, pegs, and may be arranged in various other shapes and sizes.

In the embodiment shown in FIGS. 1–4, the bridge assembly 34 includes six slidable saddle members 36 which are used to retain six corresponding bullets 118 of guitar strings 1 14. These six strings 114 may correspond to the musical notes E, A, D, G, B and E, respectively. Guitar strings having bullet-shaped anchors arranged at both ends thereof secured in bridge saddle members and string holder cavities of a nut assembly are also disclosed in U.S. Pat. No. 5,705,760 which has been issued to Floyd D. Rose, the inventor of the present invention. The disclosure in the '760 patent is incorporated by reference herein.

The unique structure and operation of bridge assembly 34 is highly desirable when used in a stringed instrument, such as guitar 20 which includes a convergence tuning system. The term "convergence" as used herein refers to the substantially simultaneous occurrence of harmonic and pitch tuning of one or more strings of a guitar or other stringed instrument. This means that the string will simultaneously be harmonically tuned and pitch tuned upon performing a single adjustment which concurrently affects the string tension and the distance between a pair of critical contact surfaces on the associated instrument. The term "critical contact surface" is intended to designate the contact points on a guitar, or other stringed instrument, at which the strings are supported and between which the strings vibrate at a certain frequency so that a desired tone is obtained. The critical contact points typically exist at the nut and bridge of a guitar so that the distance between corresponding critical contact points at the nut and bridge define the harmonic length of an associated string. With respect to guitar 20, both the bridge assembly 34 and the nut assembly 128 includes critical contact surfaces between which the strings 114 vibrate.

The bridge assembly 34 includes a base 35 in which the slidable saddle members 36 are arranged. Each of the saddle members 36 include a bullet holding portion 38, which may be considered the true saddle portion of saddle members 36. As best shown in FIG. 2, bullet holding portions 36 include a hollow cavity having an opening 40 for receiving bullet 118 at an end of a corresponding string 114. The saddle members 36 also include a slot 42 open to the bullet holding cavity through which a corresponding string 114 extends when in assembled position. String 114 then contacts critical contact surface 44 at the proximal-most end of the saddle member 36.

Saddle member 36 also includes a central angled section 46 and a lower horizontally planar section 48. A downwardly extending vertical section 50 is arranged at the distal-most end of the lower planar section 48. As clearly shown in FIGS. 3 and 4, a roller 52 is pinned into assembled position at the juncture of lower horizontal section 48 and vertical section 50.

The bridge assembly 34 includes a unique force conversion assembly which performs the function of converting a nonlongitudinal force (e.g., a rotational, angular or vertical force) into a longitudinal force which effects slidable longitudinal movement of saddle member 36. In the embodiment shown in FIGS. 1–4, the force conversion assembly includes the combination of various levers, a tuning knob, and other components in combination with a portion of saddle member 36. The function of the force conversion assembly will be discussed below following a description of the structural components thereof, which include a small central lever arm 54 having an upper end 56 and a lower end 58. The upper end 56 includes a passageway (unnumbered) that is placed in alignment with passageways (unnumbered) near the bottom-most end of lower vertical section 50. A pin 60 (shown in the exploded view of FIG. 3) is used to secure the upper end 56 of small lever arm 54 to the downwardly extending vertical portion 50 of saddle member 56.

As also shown in FIGS. 3 and 4, a large lever arm 62 is arranged below small lever arm 54. The large lever arm 62 includes an upper end 64 which is adapted to be connected to the base 35 of bridge assembly 34 via elongated pin 68. Although the structure can change in alternate embodiments, in the illustrated embodiment a single elongated pin 68 may be used to secure the upper end 64 of each of the six lower lever arms 62 to the base 35 through a common passageway (not shown).

The lower end 66 of large lever arm 62 includes a forked portion for receiving the cylindrical end members 88 of riser 84. As best shown in FIG. 3, riser 84 includes a central threaded aperture 86. A central portion of lever arm 62 includes a pair of apertures (unnumbered) which are aligned with apertures (also unnumbered) at a lower end 58 of small lever arm 54. A pin 70 is placed through the aligned apertures to secure the lower end of lever arm 54 to the central portion of lever arm 62.

Large lever arm 62 includes a recessed portion 67 which is sized and shaped to receive the downwardly extending vertical portion 50 of saddle member 36 when the lever arm 62 is in its most horizontal position. This structure will be discussed further below in connection with the operation of the tuning system of the guitar 20.

A spring 72 is also secured by pin 70 at the lower end 58 of lever arm 54. The spring 72 will bias the lever arm 54 to an upward angular position with respect to lever arm 62.

Bridge assembly 34 includes a tuning screw 74 which is used for tuning guitar 20 and loading strings 114 therein as discussed further below. The tuning screw 74 includes a cylindrical head 76 and an elongated threaded shaft 78 which is arranged within threaded aperture 86 of riser 84. The cylindrical head 76 of tuning screw 74 is arranged within corresponding counter-bore 80 of bridge base 35 when in assembled position. In such position, threaded shaft 78 extends through central aperture 82 of the counter-bore 80.

A significant aspect of the present invention relates to the structure and operation of bridge assembly 34. In particular, slidable movement of a particular saddle 36 may be obtained by rotating the head 76 of a corresponding tuning screw 74. For example, as the head 76 of tuning screw 74 is rotated clockwise, it causes an associated saddle member 36 to slide away from the nut. Thus, the corresponding critical contact point 44 is moved away from the critical contact point at the nut assembly 28. Similarly, when head 76 of tuning screw 74 is rotated counterclockwise, the corresponding saddle 36 slides toward the nut assembly 28 thus moving the bridge critical contact point 44 closer to the nut critical contact point.

Slidable movement of the saddles 36 is obtained by the unique structure and operation of the force conversion assembly components shown in FIG. 3. The unique arrangement of levers, and other components facilitate the conversion of rotational, vertical and angular forces to a slidable force which effects slidable movement of saddles 36 along the longitudinal axis of neck 24 (i.e., along the length of strings 114).

In operation, when it is desired to load a string 114 into assembled position where bullet 116 is arranged within a corresponding cavity 30 of the nut assembly 28, and bullet 118 is arranged within a corresponding cavity of a saddle member 36 at bridge assembly 34, the saddle member 36 should be adjusted to slide forward toward the nut assembly 28. This may be accomplished by rotating tuning screw 74 counter clockwise until a corresponding saddle 36 moves to a sufficiently forward position where a string 114 can be loaded without a great deal of tension. As the tuning screw 74 is rotated counter clockwise, the riser 84 is threaded downwardly along the threaded shaft 78. This downward movement of riser 84 forces the lower end 66 of lever arm 62 downwardly so that the lever arms 54 and 62 become arranged in a more extended (i.e., vertically oriented) position.

Similarly, when tuning screw 74 is rotated clockwise, the riser 84 is threaded upwardly along the threaded shaft 78.

This upward movement of riser 84 forces the lower end 66 of lever arm 62 upwardly toward the vertically extending portion 50 of the saddle member 36. Thus, lever arms 62 and 54 both become arranged in a more compressed (i.e., horizontally oriented) position. This causes the saddle member 36 to slide away from the nut assembly 28 such that the tension on an associated string 114 is increased until a convergently tuned state is obtained (i.e., when harmonic and pitch tuning are simultaneously achieved). At its uppermost position, the bottom of vertical extension 50 at the end of saddle member 36 fits within recess 67 of lever 62.

The force conversion assembly includes various components including the combination of a portion of saddle member 36, lever arms 54 and 62, tuning screw 74, riser 84 and other components which maintain the foregoing components in assembled position. This assembly allows rotational movement of tuning screw 74 to convert both vertical and angular forces along lever arms 54 and 62 as the riser 84 is moved upwardly and downwardly along the threaded shaft 78. Contact between roller 52 and the underside of base 35 also facilitate conversion of the rotational, vertical and angular forces to a horizontal force which effects longitudinal slidable movement of the saddle member 36.

The structure and operation of the force conversion assembly is such that rotation of tuning screw 74 through a certain rotational distance will effect a relatively large longitudinal movement of a corresponding saddle member 36 when tension in an associated string 114 is relatively small (i.e., when the saddle member 36 is arranged relatively close to the nut assembly 28). Conversely, when the tension in an associated string 114 is relatively high (i.e., when the saddle member 36 is arranged relatively far from the nut assembly 28) rotation of tuning screw 74 through the same rotational distance will effect a relatively small longitudinal movement of saddle member 36. Notwithstanding the disproportional distance of longitudinal movement of saddle member 36 in response to rotation of tuning screws 74 when a corresponding string 114 is under different tensions, the structure and operation of the lever arms 54 and 62 render it relatively easy to rotate an associated tuning screw 74 at all times regardless of the string tension. This is because when the tension in an associated string 114 is relatively high the relatively horizontal orientation of the lever arms 54 and 62 are positioned to provide additional leverage which reduces, or at least substantially maintains, the amount of rotational force required to turn tuning screw 74.

In a preferred embodiment of the present invention, the bridge assembly 34 is shown as a tremolo bridge, which includes a tremolo plate 92. However, it should be appreciated that the present invention covers bridge assemblies that do not pivot and thus are not tremolos. As is known in the stringed instrument art, a tremolo may be used when it is desired to obtain unusual tone variations. This occurs when the tension in all of the strings is rapidly increased or decreased during playing of an electrical guitar. However, it should be understood that various features of the present invention may be used in guitars which do not include a tremolo.

The bridge assembly 34 includes a significant improvement over prior art designs in that it has a tremolo plate 92 with a surface arranged substantially coplanar (i.e., flush) with the surface of the body 22. This provides the advantage of a "hidden" tremolo where it is not apparent that guitar 20 includes a tremolo (as it does not have a traditional tremolo arm), but a tremolo effect may be obtained by depressing the tremolo plate 92 downwardly. The tremolo plate 92 includes a first end 94 connected to the base 35 of bridge assembly 34. A second end 96 of tremolo plate 92 is remote from the base 35. When arranged in assembled position on guitar body 22, the tremolo plate 92 may appear as shown in FIG. 1.

Figure 11:
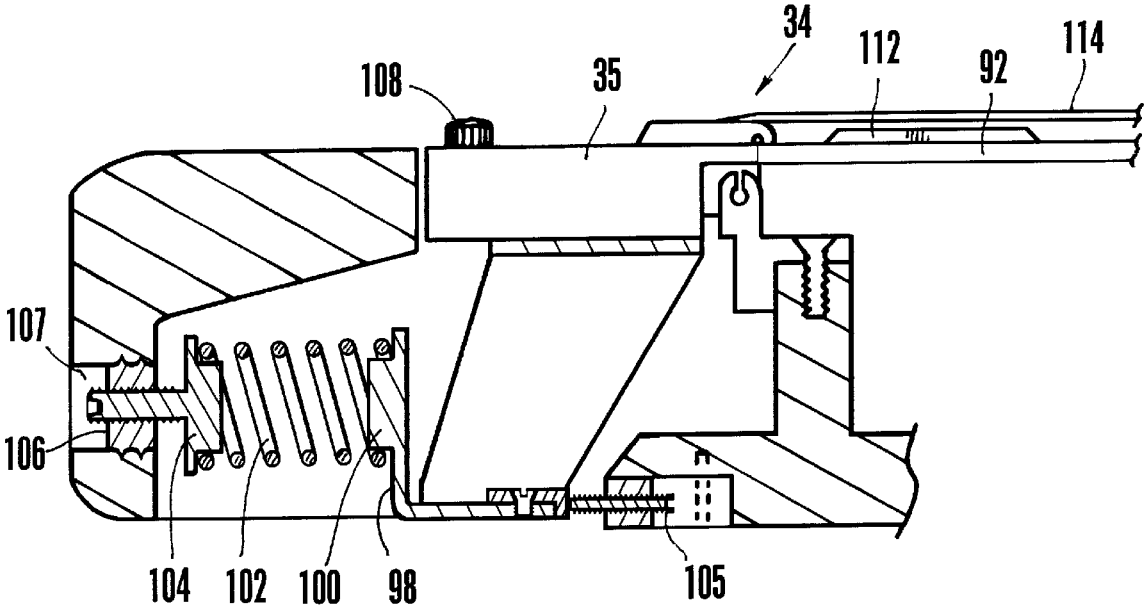
FIG. 11 is a cut away cross sectional view taken along line 11—11 of FIG. 1.

As best shown in FIGS. 3 and 11, the bridge assembly 34 includes an L-shaped bracket 98 which is secured to a lower fixed portion of the bridge base 35. The L-shaped bracket 98 has a vertically extending section and a circular spring connector 100 thereon. A coil spring 102 extending within the body 22 includes a first end connected to connector 100 and a second end secured to a head of mounting screw 104. The mounting screw 104 includes a threaded shaft arranged within a threaded passageway of locking hardware 106 when in assembled position. Locking hardware 106 is arranged within a passageway 107 that extends through the body 22 of guitar 20 at the end thereof. Passageway 107 facilitates access to locking hardware 106 and the mounting screw 104 therein so that a user may selectively adjust the tension in coil spring 102.

Figure 10:
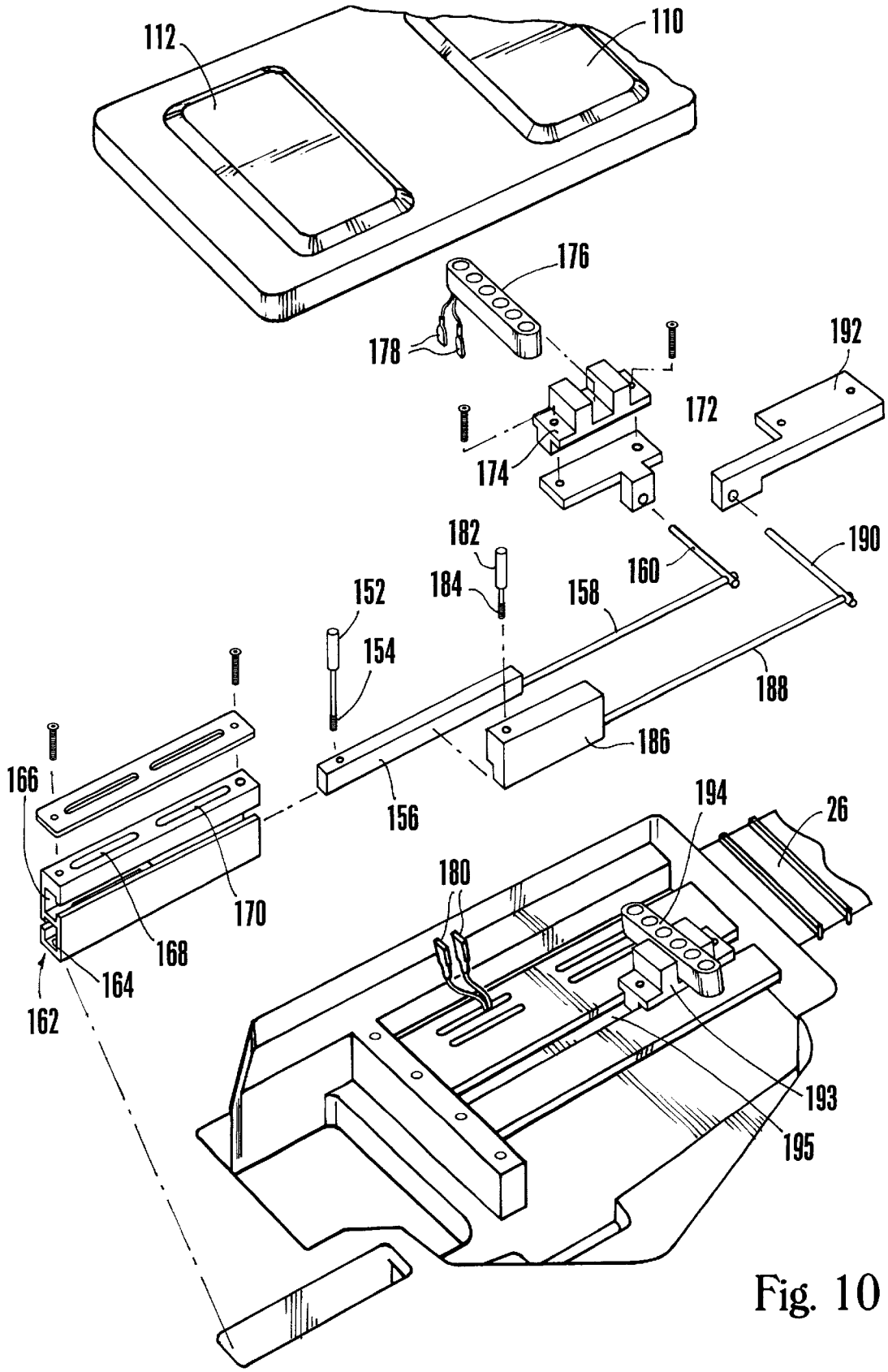
FIG. 10 is a partially exploded view of the pick-up assembly and associated control mechanism of the present invention.

With reference to FIGS. 1, 3 and 10, the surface of tremolo plate 92 includes a recess and a passageway (unnumbered) in which adjustable volume control knob 108 is arranged. As also shown in FIG. 1, a receptacle 89 is arranged on the body 22 and is adapted to receive a guitar cord which may be plugged into an associated amplifier (not shown).

FIG. 2 illustrates the tremolo plate 92 when a user exerts a downward force upon the second end 96 thereof and causes it to become depressed into the cavity of the body 22 below the surface of body 22. The functionality of tremolo bridge assembly 34 is similar to prior art tremolos in that as tremolo plate 92 is pushed downwardly, the entire bridge assembly 34 rotates toward the nut assembly 125 and thus tension is decreased in strings 114. When the user releases the force from the forward end 96 of tremolo plate 92, the coil spring 102 biases the bridge assembly 34 and the tremolo plate 92 back to its at rest position as shown in FIG. 1 and tension is returned to guitar strings 114.

If a user desires to momentarily increase the tension in strings 114 while playing the guitar 20, the stopping screw 105 shown in FIG. 11 must initially be adjusted so that it is remote from the bottom of the bridge assembly 34. This will permit the user to increase the tension in associated strings 114 by pressing downwardly on the rear most portion of bridge assembly 34. The second end 96 of tremolo plate 92 will then become raised above the surface 22 of guitar 20. In effect, this creates a higher pitched sound.

The flush arrangement of tremolo plate 92 in its at rest position provides advantages in both use of the tremolo bridge assembly 34 and the overall appearance of the guitar 20. One advantage of the flush tremolo plate 92 is that it provides an open playing surface that does not interfere with movement of a user's hands on the guitar body 22. This arrangement overcomes a problem that existed with prior art guitars where a tremolo arm was raised above the surface of a guitar body. Such prior art tremolo arms did not provide an open playing surface and thus have the drawback of sometimes interfering with a user's hands during playing of the guitar.

Another feature of the present invention relates to a readily removable and replaceable headstock. This aspect of the present invention is shown in FIGS. 1 and 5–7. When a user desires to take advantage of the unique convergence tuning aspect of the present invention, headstock 32 may be utilized. In this embodiment, convergence tuning is accomplished by selective adjustment of tuning knobs 76 of the bridge assembly 34. There is no need to perform any adjustment of the strings 114 at the nut assembly 28. Thus, head stock 32 does not include any rotatable tuning pegs as required for pitch tuning in conventional guitars.

In this embodiment, the nut assembly 28 may be separately connected at an end of the neck 24. However, it should be appreciated that in alternate embodiments, the nut assembly 28 may be formed as part of the neck 24. Regardless of whether the nut assembly 28 is formed as part of the neck 24 or is separately connected to an end of the neck 24 remote from the body 22, it should be appreciated that for the purpose of the terminology used herein, the headstock 32 will be considered to be "connected" to the second end of the neck 24. In the description of the preferred embodiment shown in FIG. 6 which follows, the headstock 32 and alternate headstock 134 are actually directly connected to the housing 125 of nut assembly 28 and are thus, indirectly connected to the end of neck 24. In this arrangement, it is considered as if the headstocks 32 and 134 are still "connected" to the neck 24.

Figure 6:
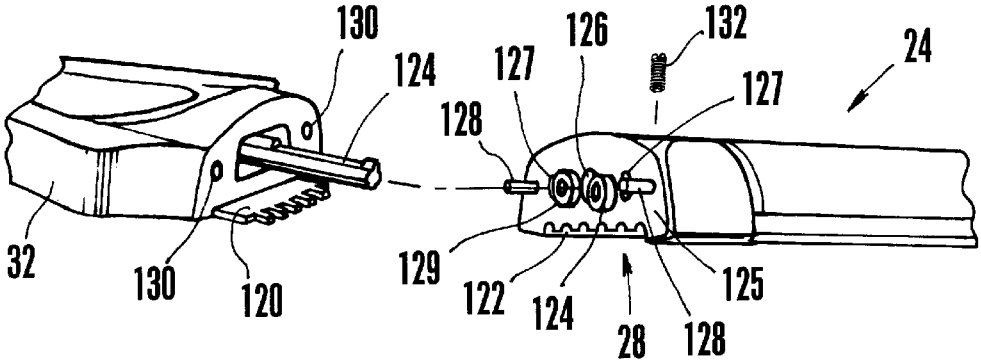
FIG. 6 is a partially exploded view of the headstock with respect to the nut assembly and neck shown in FIG. 4.

With reference to FIG. 6, a partially exploded rear view is illustrated, where it is apparent that the headstock 32 can be selectively attached to and detached from nut assembly 28. A plate 120 which forms part of the rear portion of cavities 30 of the nut assembly 28 extends outwardly from the connecting end of head stock 32. In assembled position, the plate 120 is arranged adjacent to cavity forming section 122 of the nut assembly 28. In the embodiment shown in FIGS. 6 and 8, the nut assembly 28 includes a housing 125 and the actual nut 131 including the nut critical contact points (unnumbered) which support strings 114.

The head stock 32 has mounting hardware including a central extension rod 124 and a plurality of post holes 130 arranged on the end of headstock 32 on either side of central extension rod 124. These components are useful to facilitate removal and replacement of the headstock 32 with respect to the nut assembly 28 and the neck 24.

As also shown in FIG. 6, nut housing 125 includes an end which abuts the end of the headstock 32 when in assembled position. Nut housing 125 includes a central passageway 126 which is sized and shaped to receive central extension rod 124 of headstock 32. A pair of pins 127 extend from opposing sides of nut housing 125 and are adapted to be inserted within post holes 130 of the headstock 32.

The nut plate 131 is secured to the nut housing 125 by a pair of screws (not shown) which extend within corresponding passageways 127. The entire nut assembly 28 including nut housing 125 and nut plate 131 may be secured to an end of the neck 24 by locking screws 129, the heads of which are visible in FIG. 6.

When the end of the headstock 32 is placed in abutment with the end of nut housing 125, a set screw 132 may be used to secure the headstock 32 in assembled position. In order to remove headstock 32, a user may simply loosen set screw 132. Headstock 32 can then be pulled from its assembled position on nut housing 125.

As shown in FIG. 6, the extension rod 24 includes a flat surface against which an inner end of set screw 132 will abut when head stock 32 is arranged in assembled position. The inner end of set screw 132 may include a teflon coating so that it is free to slide along the flat underside of extension rod 124 when it is not fully tightened thereon. This will allow the user to slide the headstock 32 between a string loading position (shown in FIG. 5), where the headstock 32 is pulled away from the nut housing 125, and a string retaining position where headstock 32 fully abuts against nut housing 125 (shown in FIG. 8). A raised portion (unnumbered) at the end of extension rod 124 acts as a stopping surface with respect to set screw 132 so that headstock 32 cannot be fully removed unless set screw 132 is further loosened or removed.

Figure 7:
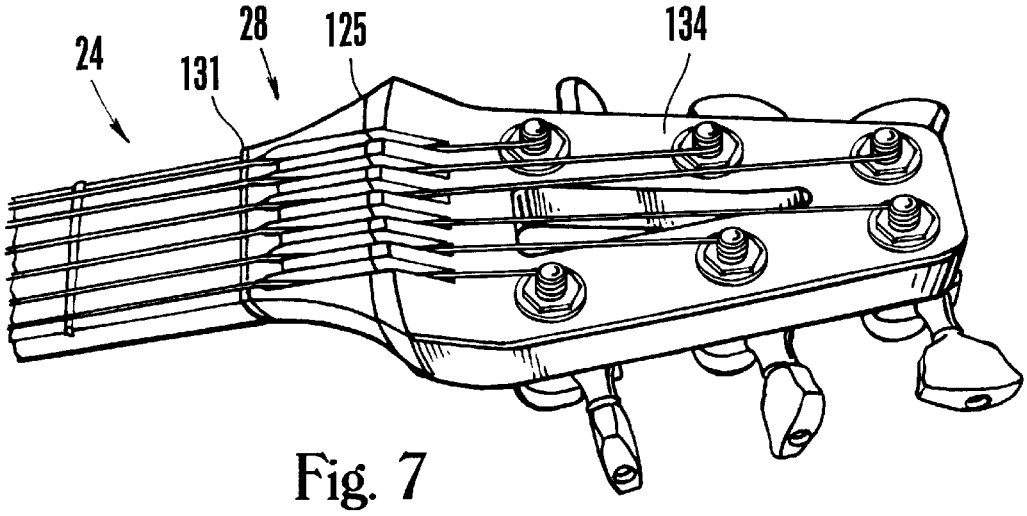
FIG. 7 is an isolated perspective view of an alternate headstock in assembled position.

It may be desirable in certain circumstances to modify the aesthetic appearance of headstock 32. Thus, the present invention allows for readily removing and replacing various headstocks provided that such headstocks include the connecting system features discussed above and shown in FIG. 6. In certain circumstances, it may also be desirable to convert the present guitar 20 from a convergence tuning system to a more traditional tuning system. Such a traditional tuning system may include strings having at least one end without bullets thereon. This embodiment is shown in FIG. 7 where alternate headstock 134 is arranged on nut assembly 28. Alternate headstock 134 includes somewhat traditional tuning pegs (unnumbered) which retain an end of associated guitar strings for increasing or decreasing the tension thereof. This more traditional type of headstock may also be used in connection with the convergence tuning system of the present invention. In order to facilitate readily removing and replacing headstock 32 with alternate headstock 134, the mounting hardware on the end of headstock 134 should be substantially the same as the mounting hardware on the end of headstock 32.

Another advantageous feature of the present invention relates to a releasable and adjustable "ball and socket" connection between the neck 24 and the body 22. In particular, the exploded view of FIG. 9 shows the convex bottom surface 136 of the neck 24 at an end which is adapted to be mounted on the body 22. The convex bottom surface 136 comprises a portion of a sphere, and will thus be described herein as spherical. A wedge 138 which is used as a "memory lock" as discussed below, is adjustably mounted on convex surface 136 by mounting screws 137 and 139. A threaded passageway 140 is arranged adjacent to the end of wedge 138 for facilitating releasable attachment of the neck 24 to the body 22.

The body 22 includes a concave socket 142 for receiving convex surface 136 of neck 24. A wedge-shaped recess 144, which is slightly larger than wedge 138, is arranged within socket 142. The wedge-shaped recess 144 includes passageways 143 and 145 which permit access to adjustment screws 137 and 139, respectively. Wedge shaped recess 144 also includes elongated passageway 146 which may be slot shaped to permit adjustable alignment with threaded passageway 140. A protective external plate 150 is arranged on the rear side of body 22 and includes through holes (unnumbered) which are aligned with passageways 143, 145 and 146. A bolt 148 having a threaded shaft is extended upwardly through a corresponding hole of plate 150 and aligned slotted passageway 146 and into threaded passageway 142 to secure the neck 24 in assembled position on the body 22.

The convex surface 136 at the end of neck 24 is preferably curved in all directions, as is the bottom of a sphere. The relationship between the size and shape of the concave pocket 142 on the body 22 and the convex surface 136 permits the neck 24 to be adjustable on the body 22 before it is secured in assembled position so that the user can customize a "desired action." As used herein, and as known in the art, the term "action" relates to the height distance between the fret board 26 and the strings 114, as well as the side-to-side positioning of the strings 114 with respect to the fretboard 26. Thus, the neck 24 can be adjusted within concave pocket 142 of the body 22 in three dimensions (i.e., along the x, y and z axes).

When assembling the neck 24 onto the body 22 of guitar 20, the convex surface 136 of the neck 24 is placed within the concave surface 142 of the body 22. At this time, the wedge 138 is placed within corresponding recess 144. The passageways 143 and 145 within the recess 144 are sufficiently large to permit adjustment of the neck 24 and the wedge 138 while retaining access to adjustment screws 137 and 139 through corresponding passageways 143 and 145. Similarly, slotted passageway 146 is large enough to allow sufficient adjustment of the neck 24 while permitting bolt 148 to pass through passageway 146 and into threaded passageway 140 so that the neck 24 can be secured in assembled position.

In accordance with the present method of customizing the action of guitar strings 114 after the convex surface 136 of the neck 24 is placed within the concave surface 142 of the body 22, it is preferable to initially tighten bolt 148 within threaded passageway 140 so that the neck 24 is snug (but not fully tightened) with respect to the body 22. This "snug" arrangement permits a user to then adjust the position of the neck 24 so that a desired action setting can be obtained in any of the three dimensions. As the neck 24 is being adjusted, the wedge 138 is adjusted to a corresponding position within wedge-shaped recess 144.

When a desired action setting is achieved, bolt 148 should be securely tightened against cover plate 150 so that the neck 24 is secure and cannot be manipulated within concave socket 142 of the body 22. In order to secure the wedge 38 in a locked position, it is preferable for a user to initially tighten adjustment screw 137 until it is snug. This will pull the wedge 138 to a desired locked position against the side walls of wedge-shaped receptacle 144. Adjustment screw 139 should then be securely tightened and adjustment screw 137 can then be fully tightened to secure the wedge 138 in its final locked position.

The combination of the wedge 138 and corresponding shaped recess 144 may be considered a memory lock device which provides two important functions. First, it is a stabilizer which facilitates the stable and secure mounting of the neck 24 to the body 22 of the guitar 20. Second, it serves as a memory lock so that a user can disassemble the neck 24 with respect to the body 22 by removing the bolt 148 from its tightened position within threaded recess 140, and can later reassemble the neck 24 to the body 22 without time consuming readjustment procedures required to obtain a customized action setting. More particularly, when the convex surface 136 of the neck 24 is returned into the concave pocket 142, the wedge 138 will automatically return to its previously locked position within corresponding wedge-shaped recess 144 whereby the user's customized action setting is restored without additional adjustment after the bolt 148 is fully tightened.

Another significant feature of the present invention is the arrangement of a planar cover for slidable pick-up assemblies. As shown in FIGS. 1, 2 and 10, a pair of covers 110 and 112 are arranged on the body 22 of guitar 20 beneath and in close proximity to strings 114. These covers are unique in that slidable pick-ups which detect vibrations of the strings 114 and facilitate amplification thereof are arranged beneath such covers and are free to move within the cavity of guitar body 22 as discussed below. It is also significant that pick-up covers 110 and 112 are preferably raised slightly above the surface of the guitar body 22 so that the associated pick-ups can be arranged in close proximity to the strings 114. However, it should be appreciated that covers which are flush or even slightly recessed below the surface of the guitar body 22 are within the scope of the present invention.

Figure 12:
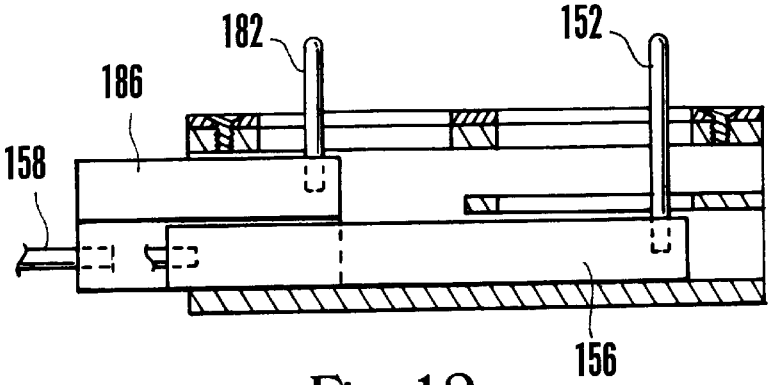
FIG. 12 is a cut away cross sectional view taken along line 12—12 of FIG. 1.

As shown in FIGS. 10 and 12, guitar 20 includes a pair of slidable pick-ups 176 and 194 are arranged on corresponding pick-up assemblies (not generally numbered). In alternate embodiments of the present invention, one or more fixed or slidable pick-ups may be employed. A "split" pick-up embodiment is discussed below in connection with FIGS. 13 and 14.

Yet another significant aspect of the present invention relates to mechanical control assemblies for controlling slidable movement of pick-ups within the cavity of body 22. A preferred embodiment of such control assemblies will now be described with reference to FIGS. 1 and 10. Each control assembly includes a slidable control rod. A pair of control rods 152 and 182 extend out of the surface of body 22 and are free for slidable movement within corresponding slots (unnumbered). A first vertical control rod 152 is the rear most pick-up control rod. It includes a threaded lower end 154 which is received within a threaded passageway of a first longitudinally extending block 156. A further extension rod 158 extends longitudinally from an end of block 156. A transverse rod 160 is secured to an end of the extension rod 158 and is received within a passageway of mounting plate 172. A second mounting plate 174 includes a slot for retaining first pick-up 176 therein and is secured by screws to the top surface of mounting plate 172.

Pick-up 176 includes detachable leads 178 which are adapted to be plugged into electrical receptacles 180 as shown in FIG. 10. A guide block 162 is also shown in FIG. 10. It is mounted within body 22 of guitar 20 when in assembled position. Guide block 162 includes a lower track 164 which is sized and shaped to receive longitudinally extending block 156 for slidable movement therein. Guide block 162 also includes an upper track 166 which is sized and shaped to receive a second slidable block 186 associated with a second pick-up control assembly as discussed further below.

Guide block 162 also includes a rear guide slot 168 through which the first vertical control arm 152 extends and a forward guide slot 170 through which a second vertical control arm 182 extends. This second control arm also includes a threaded lower end 184 which is secured within a threaded passageway of associated slidable block 186. A longitudinally extending rod 188 is attached to one end of slidable block 186. A transverse rod 190 is then secured to a remote end of longitudinally extending rod 188 and secured to mounting plate 192. A second mounting plate 193 is arranged on the surface of mounting plate 192 and second pick-up 194 is carried in assembled position within a slot of mounting plate 193. Although not shown in FIG. 10, second pick-up 194 also includes leads removably connected to corresponding receptacles within the body 22 of guitar 20.

No prior art pick-up arrangement includes a mechanical control assembly which can be simply and manually adjusted by the user to obtain a desired sound. As also shown in FIG. 10, the combination of mounting plates 172 and 174 form a first slidable carriage on which first pick-up 176 is arranged while the combination of mounting plates 192 and 193 form a second slidable carriage on which second pick-up 194 is arranged. The location of the electrical receptacles 180 can vary within the scope of the present invention. For example, in an alternate embodiment, the electrical receptacles may be mounted on the first and second slidable carriages to facilitate a plug-in pick-up arrangement.

In the preferred embodiment shown in FIGS. 1–12, first pick-up 176 and second pick-up 194 are arranged within the same track 195. First pick-up 176 is used to detect vibrations in strings 114 which are relatively closer to bridge assembly 34 while second pick-up 194 are used to detect vibrations in strings 114 which are relatively closer to nut assembly 28. Thus, raised cover 112 corresponds to first pickup 176 while raised cover 110 corresponds to second pick-up 194. The width of these covers is at least slightly greater than the width of the corresponding pick-ups so that the pick-ups are free for slidable movement beneath the covers.

Where two or more pick-ups are used as part of the present invention, as in the embodiments of FIGS. 1–12, the guitar 20 may include a pick-up selection switch 109 extending from the body 22. Pick-up selection switches are known in the art and provide the user of the guitar with the ability to selectively activate one or more of the associated pick-ups. For example, pick-up selector switch 109 may have three positions (1) upward—where it is directed away from the strings; (2) center; and (3) downward—where it is directed toward the strings. When pick-up selection switch 109 is in its upward position, only second pick-up 194 is activated. When pick-up selection switch 109 is in its center position, both pick-ups 176 and 194 are activated. Finally, when pick-up selection switch 109 is in its downward position, only pick-up 176 is activated.

Figure 13:
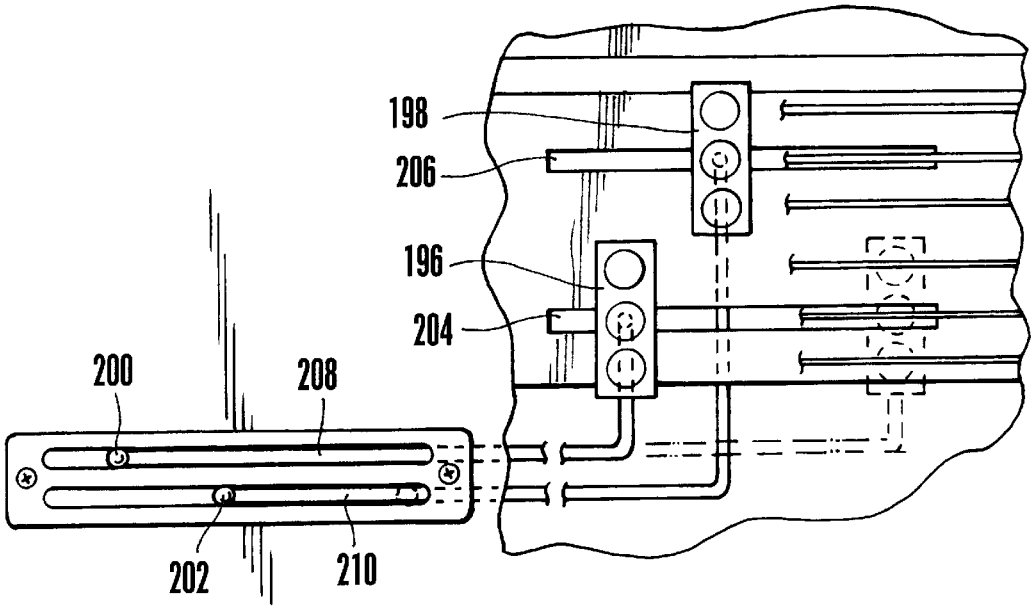
FIG. 13 is a schematic isolated view of a second embodiment of a pick-up assembly used in connection with the present guitar.
Figure 14:
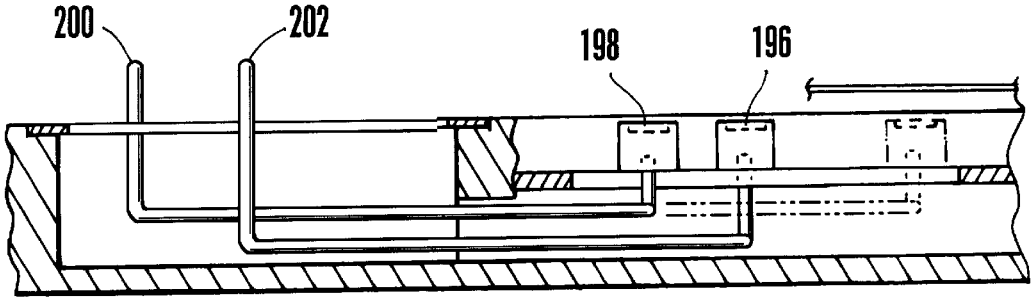
FIG. 14 is a cut away cross sectional view taken along line 14—14 of FIG. 13.

FIGS. 13 and 14 relate to another embodiment of the present invention where split pick-ups are used. Instead of including transducers corresponding to each of the six strings 114, a first pick-up 196 and a second pick-up 198 are arranged in a side by side relationship, each pick-up including three transducer members corresponding to three of the strings 114. The first pick-up 196 is arranged for slidable movement within track 204 as it is mechanically connected to control arm 200. Control arm 200 is free for selective slidable movement within corresponding track 208. Similarly, control arm 202 is free for selective slidable movement within track 210 and is used to control movement of pick-up 198 within corresponding track 206.

While the foregoing detailed description and drawings are directed toward the preferred embodiments of the present invention, it should be appreciated that numerous modifications can be made to the structure and orientation of the various components of the present stringed instrument. Indeed, such modifications are encouraged to be made in the materials, structure and arrangement of the components of the present stringed instrument without departing from the spirit and scope of the present invention. Accordingly, the foregoing description of the preferred embodiments should by taken by way of illustration rather than by way of limitation as the present invention is defined by the claims set forth below.

I claim:

1. A stringed instrument comprising:

a body including a substantially planar surface and a cavity arranged beneath said surface;

a plurality of strings extending above and along said body; and a tremolo bridge mounted on said body, said tremolo bridge including a base and a plate enclosing an opening to said cavity, said plate having a first end connected to said base and a second end remote from said base extending substantially coplanar between said first and second ends with respect to said surface of said body.

2. The stringed instrument of claim 1 further comprising a neck having a first end mounted on said body, and a second end remote from said body, said plurality of strings extending longitudinally along said neck.

3. The stringed instrument of claim 2 further comprising a nut connected to said neck, said plurality of strings extending between said bridge and said nut.

4. The stringed instrument of claim 3 wherein said tremolo bridge is operatively connected to said body such that a user of said stringed instrument can obtain a desired sound upon activation of said tremolo bridge by pressing on said tremolo plate whereby said tension in said strings is momentarily decreased or increased and is then returned.

5. The stringed instrument of claim 1 wherein said tremolo bridge is arranged for movement between a rest position where said plate is substantially coplanar with respect to said surface of said body, and an operative position where at least a portion of said plate extends below said surface of said body.

6. The stringed instrument of claim 5 wherein said tremolo bridge includes a spring arranged within said cavity of said body to bias said plate to said rest position.

7. The stringed instrument of claim 5 wherein said tremolo bridge includes a base, said plate has a first end connected to said base and a second end remote from said base, said second end being movable to extend below said surface of said body when said plate is urged to said operative position.

8. A stringed instrument comprising:

a body including a substantially planar surface and a cavity arranged beneath said surface;

a neck having a first end mounted on said body, and a second end remote from said body;

a plurality of strings extending longitudinally along said neck and said body;

a nut connected to said neck; and a tremolo bridge connected to said body, said plurality of strings extending between said bridge and said nut, said tremolo bridge including a base and a plate enclosing an opening to said cavity of said body, said plate having a first end connected to said base and a second end remote from said base, said plate being arranged for movement between a rest position where it is substantially coplanar between said first and second ends with respect to said surface of said body, and an operative position where at least a portion thereof extends below said surface of said body.

9. The stringed instrument of claim 8 wherein said tremolo bridge is operatively connected to said body such so that a user of said stringed instrument can obtain a desired sound upon activation of said tremolo bridge by pressing on said tremolo plate whereby said tension in said strings is momentarily decreased and is then returned.

10. The stringed instrument of claim 8 wherein said tremolo bridge includes a spring arranged within said cavity of said body to bias said plate to said rest position.

11. The stringed instrument of claim 8 wherein said tremolo bridge includes a base, said plate has a first end connected to said base and a second end remote from said base, said second end being movable to extend below said surface of said body when said plate is urged to said operative position.

12. A stringed instrument comprising:

a body including a substantially planar surface and a cavity arranged beneath said surface;

a plurality of strings extending across said body; and a tremolo bridge mounted on said body, said tremolo bridge including a base and a plate enclosing an opening to said cavity, said plate having a first end connected to said base and a second end remote from said base, said plate being arranged for movement between a rest position where it extends substantially coplanar between said first and second ends with respect to said surface of said body, and an operative position where it extends at an acute angle with respect to said surface of said body.

13. The stringed instrument of claim 12 further comprising a neck having a first end mounted on said body, and a second end remote from said body, said plurality of strings extending longitudinally along said neck.

14. The stringed instrument of claim 12 wherein said tremolo includes a spring arranged within said cavity of said body to bias said plate to said rest position.

15. The stringed instrument of claim 12 wherein said plate has a first end connected to said bridge and a second end remote from said bridge, said second end being movable to extend below said surface of said body when said plate is urged to said operative position.

16. The stringed instrument of claim 15 wherein said tremolo bridge is operative to decrease tension of said plurality of strings as said plate is moved below said surface of said body.

17. The stringed instrument of claim 12 wherein said plate has a first end connected to said bridge and a second end remote from said bridge, said second end being movable to extend above said surface of said body when said plate is urged to said operative position at which time tension in said plurality of strings is increased.

* * * * *